US012338704B1

(12) United States Patent
Alahmdi et al.

(10) Patent No.: US 12,338,704 B1
(45) Date of Patent: Jun. 24, 2025

(54) SYSTEM FOR DEPLOYING MICROCHIPS

(71) Applicant: SAUDI ARABIAN OIL COMPANY, Dhahran (SA)

(72) Inventors: Raed Alahmdi, Thuwal (SA); Abrar Alshaikh, Dhahran (SA); Bodong Li, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/617,188

(22) Filed: Mar. 26, 2024

(51) Int. Cl.
*E21B 33/068* (2006.01)
*E21B 21/06* (2006.01)
*E21B 47/12* (2012.01)

(52) U.S. Cl.
CPC ..... *E21B 33/068* (2013.01); *E21B 21/06* (2013.01); *E21B 47/138* (2020.05)

(58) Field of Classification Search
CPC ..... E21B 21/06; E21B 33/068; E21B 47/138; B65D 83/0089; B65D 83/0409; B65D 83/0481; B08B 9/04; Y10T 137/4891; B65G 47/24; B65G 47/26; B65B 59/00; G07F 11/00
See application file for complete search history.

(56) References Cited

U.S. PATENT DOCUMENTS 801,511 A * 10/1905 Copland ..... B65D 83/0409 222/363
2,776,568 A * 1/1957 Ward ..... G01F 1/056 29/522.1
2,953,157 A * 9/1960 Osborne ..... F17D 3/08 15/104.062
3,372,705 A * 3/1968 Bodhaine ..... E21B 33/068 137/268
4,308,942 A * 1/1982 Ackley ..... B65G 47/1471 198/408
6,324,904 B1 * 12/2001 Ishikawa ..... E21B 47/26 257/E29.022
7,281,589 B2 10/2007 Robichaux et al.
10,697,261 B2 * 6/2020 Henry ..... E21B 21/062
10,999,946 B2 * 5/2021 Li ..... E21B 47/138
11,002,101 B2 * 5/2021 Golinowski ..... E21B 43/2607
11,136,872 B2 * 10/2021 Roesner ..... E21B 43/267
(Continued)

FOREIGN PATENT DOCUMENTS

CN 114263455 A 4/2022
WO 2008066391 A1 6/2008

*Primary Examiner* — Jennifer H Gay
(74) *Attorney, Agent, or Firm* — Vorys, Sater, Seymour and Pease LLP

(57) ABSTRACT

A microchip deployment system for a well includes a drilling fluid pump, a drilling fluid pipe extending from the drilling fluid pump into the well, and a microchip deployment mechanism provided on the drilling fluid pipe. The microchip deployment mechanism comprises a housing and a spherical valve. The housing has an input opening and an output opening. The spherical valve is rotatably arranged within the housing, and the spherical valve comprises a microchip pocket. The spherical valve is rotatable within the housing from a receiving position to a deploying position, wherein the microchip pocket is proximate to the input opening when in the receiving position, and wherein the microchip pocket is proximate to the output opening when in the deploying position.

17 Claims, 6 Drawing Sheets

(56) References Cited

U.S. PATENT DOCUMENTS

| | | | | |
|---|---|---|---|---|
| 11,242,724 | B2 * | 2/2022 | Young | E21B 33/068 |
| 2010/0242585 | A1 * | 9/2010 | Pratyush | E21B 49/00 901/1 |
| 2013/0118733 | A1 * | 5/2013 | Kumar | E21B 47/26 166/254.2 |
| 2014/0246189 | A1 * | 9/2014 | Beason | E21B 33/068 166/75.15 |
| 2018/0142525 | A1 * | 5/2018 | Henry | E21B 33/14 |
| 2018/0171770 | A1 * | 6/2018 | Roesner | E21B 33/068 |
| 2020/0056440 | A1 * | 2/2020 | Golinowski | E21B 43/2607 |
| 2020/0190934 | A1 * | 6/2020 | Young | E21B 33/068 |
| 2020/0367378 | A1 * | 11/2020 | Li | H05K 5/065 |

* cited by examiner

SYSTEM FOR DEPLOYING MICROCHIPS

FIELD OF THE DISCLOSURE

The present disclosure relates generally to downhole systems and tools and, more particularly, to a system for delivering microchips to a wellbore for data collection and monitoring.

BACKGROUND OF THE DISCLOSURE

During drilling operations, the drill bit and interconnected drill string are subjected to harsh downhole drilling conditions, such as high temperature and high pressure. In addition, the drill bit may encounter hard rock in the formations being drilled. To monitor downhole drilling conditions, microchips may be strategically deployed downhole in order to measure and/or transmit downhole data that can be analyzed when the microchips are recovered at surface. These data can aid in decision making and for optimization of drilling operations.

However, introducing microchips in the drilling environment has traditionally involved manual deployment of the microchips into the drilling fluid system, which is a time-consuming process and prone to human error. Further, due to their miniaturize size and deployment in large quantities, it is difficult to monitor the number of microchips actually deployed downhole. Moreover, it is difficult to control their drop orientation and the rate at which they are introduced to the fluid system.

A need, therefore, exists for an improved system that is operable to deploy and introduce drilling microchips into downhole environments.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a microchip deployment mechanism includes a housing, defining an input opening and an output opening, and a spherical valve rotatably arranged within the housing. The spherical valve includes a valve body that defines a microchip pocket sized to receive a microchip, wherein the valve body is rotatable within the housing between a receiving position, where the microchip pocket is proximate to the input opening to receive the microchip, and a deploying position, where the microchip pocket is proximate to the output opening to discharge the microchip from the microchip pocket.

In another embodiment, a microchip deployment system for a well includes a drilling fluid pump, a drilling fluid pipe extending from the drilling fluid pump and in fluid communication with a wellbore, and a microchip deployment mechanism provided on the drilling fluid pipe. The microchip deployment mechanism includes a housing having an input opening and an output opening, and a spherical valve rotatably arranged within the housing, the spherical valve including a valve body that defines a microchip pocket sized to receive a microchip. The valve body is rotatable within the housing between a receiving position, where the microchip pocket is proximate to the input opening to receive the microchip, and a deploying position, where the microchip pocket is proximate to the output opening to discharge the microchip from the microchip pocket.

In a further embodiment, a method includes loading a plurality of microchips into a hopper of microchip deployment mechanism, the microchip deployment mechanism being provided on a drilling fluid pipe and including a housing having an input opening and an output opening, and a spherical valve rotatably arranged within the housing and including a valve body that defines a microchip pocket sized to receive a microchip of the plurality of microchips. The method further includes rotating the valve body within the housing to a receiving position, where the microchip pocket is proximate to the input opening, receiving a first microchip of the plurality of microchips in the microchip pocket, rotating the valve body within the housing to a deploying position, where the microchip pocket is proximate to the output opening, and deploying the first microchip into the interior of the drilling fluid pipe when the valve body is in the deploying position.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
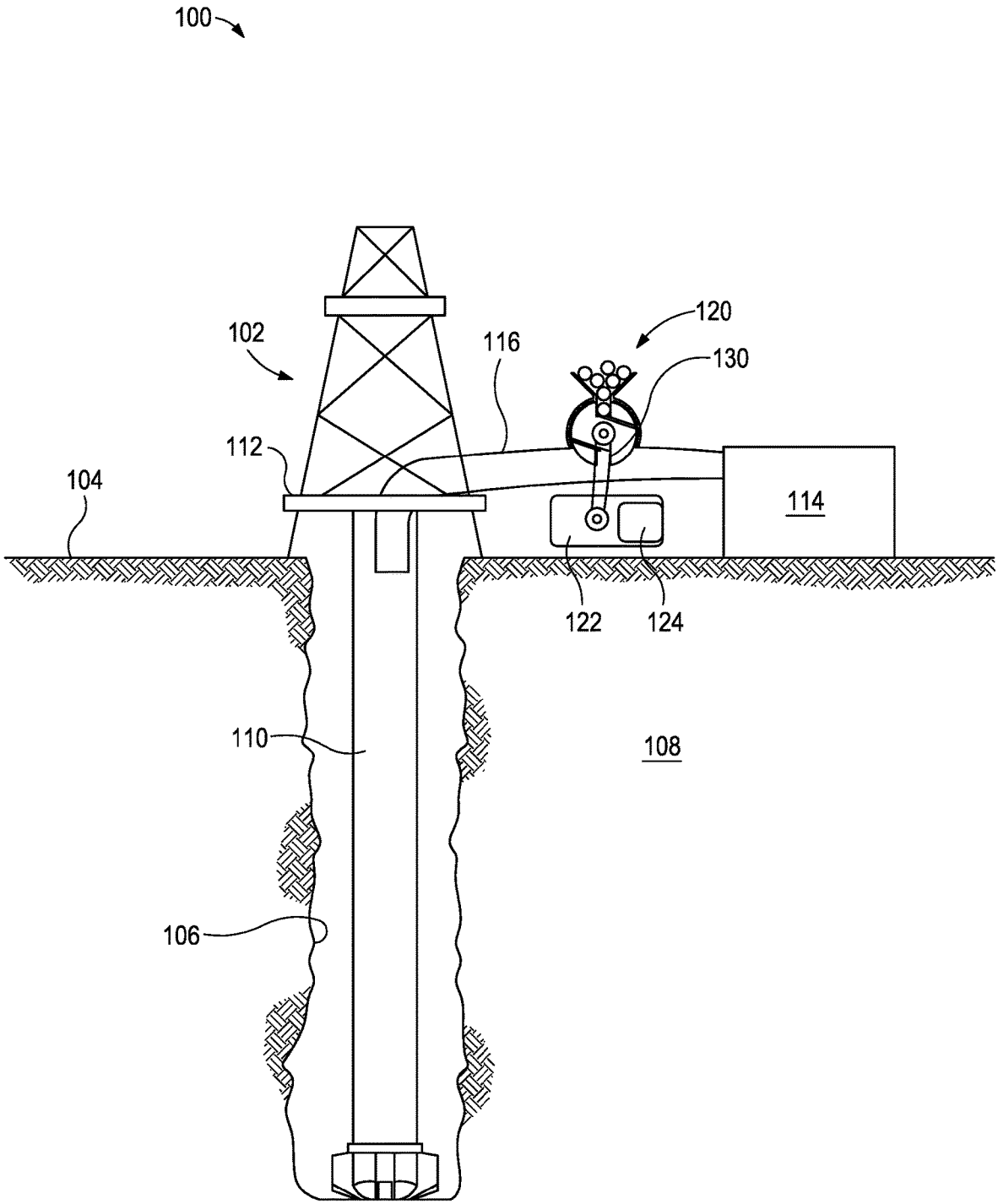
FIG. 1 is a schematic diagram of an example microchip deployment system that may incorporate the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to a system for delivering microchips to a wellbore, wherein the microchips are utilized for data collection and monitoring. The system includes a microchip deployment mechanism incorporating a spherical valve that is operable to deploy the microchips upon rotating the spherical valve. During use, the microchip deployment mechanism is positioned on a high pressure drilling fluid pipe, and the spherical valve is operable to create a seal and thereby maintain pressure within the drilling fluid pipe without allowing the high pressure to leak out of the drilling fluid pipe. The microchip deployment mechanism may also include a controller that is programmable such that the microchip deployment mechanism may deploy the microchips autonomously and based on a user programmed deployment schedule. In addition, the spherical valve may include push channels that assist in pushing/releasing the microchips from the spherical valve without compromising the pressure within the drilling fluid pipe.

FIG. 1 is a schematic diagram of an example microchip deployment system 100 that may incorporate the principles of the present disclosure. As illustrated, the microchip deployment system 100 (hereinafter "the system 100") includes a derrick 102 arranged at a well surface 104 (e.g., the Earth's surface). A wellbore 106 extends from the well surface 104 and the derrick 102 and may penetrate one or more subterranean formations 108. While the well system 100 is depicted as a land-based operation, the well system 100 may alternatively be situated in an offshore setting, such as an offshore drilling or completion rig, without departing from the scope of the disclosure.

The system 100 also includes a drilling pipe or "drill string" 110 that extends into the wellbore 106. The drill string 110 comprises a plurality of lengths of drill pipe coupled end to end and, in the illustrated embodiment, the drill string 110 is supported by the derrick 102. The system 100 also includes a rotary table 112 positioned on the derrick 102 and operable to suspend and rotate the drill string 110 and a drill bit arranged at a distal end of the drill string 110, and thereby facilitate the process of drilling the wellbore 106.

The system 100 also includes a drilling fluid pump 114 (hereinafter "the pump 114") is operable to inject and pump drilling fluid into the drill string 110. In the illustrated embodiment, the system 100 also includes a drilling fluid conduit or pipe 116 extending between the pump 114 and the drill string 110. The drilling fluid pipe 116 is operable to convey drilling fluid into the drill string 110, which flows down to the drill bit where it is discharged to help cool the drill bit and simultaneously carry cuttings and debris back to the well surface 104 within the annulus defined between the wall of the wellbore 106 and the drill string 110.

According to embodiments of the present disclosure, the system 100 may further include a microchip deployment mechanism 120 arranged on or adjacent to the derrick 102. In the illustrated embodiment, the microchip deployment mechanism 120 (hereinafter "the mechanism 120") is provided on the drilling fluid pipe 116, generally interposing the pump 114 and the drill string 110. The mechanism 120 is fluidly coupled to the drilling fluid pipe 116 and otherwise in fluid communication with the interior of the drilling fluid pipe 116. In some embodiments, at least a portion of the mechanism 120 may extend into the lumen (interior) of the drilling fluid pipe 116. As hereinafter described, the mechanism 120 is operable to deploy microchips into the drilling fluid carried within the lumen of the drilling fluid pipe 116, and the mechanism 120 is operable to isolate the pressurized (and relatively higher-pressure) drilling fluid carried within the drilling fluid pipe 116 from atmospheric pressure.

The mechanism 120 may further include a motor 122 operable to actuate the mechanism 120, as hereinafter described. In addition, the mechanism 120 may include a controller 124 in communication with the motor 122. The controller 124 may be configured to sense a speed at which the motor 122 is operating and may be configured to control (and regulate) operation of the motor 122. The motor 122 may comprise any type of prime mover capable of mechanically powering (actuating) the mechanism 120. For example, the motor 122 may include, but is not limited to, an electric motor, a hydraulic motor, or a combination thereof. In the illustrated embodiment, the motor 122 is operatively coupled to a drive shaft (see 210 in FIG. 2) of the mechanism 120 via a belt 130 such that operating the motor 122 correspondingly drives the drive shaft 210 and thereby operates the mechanism 120.

Figure 2:
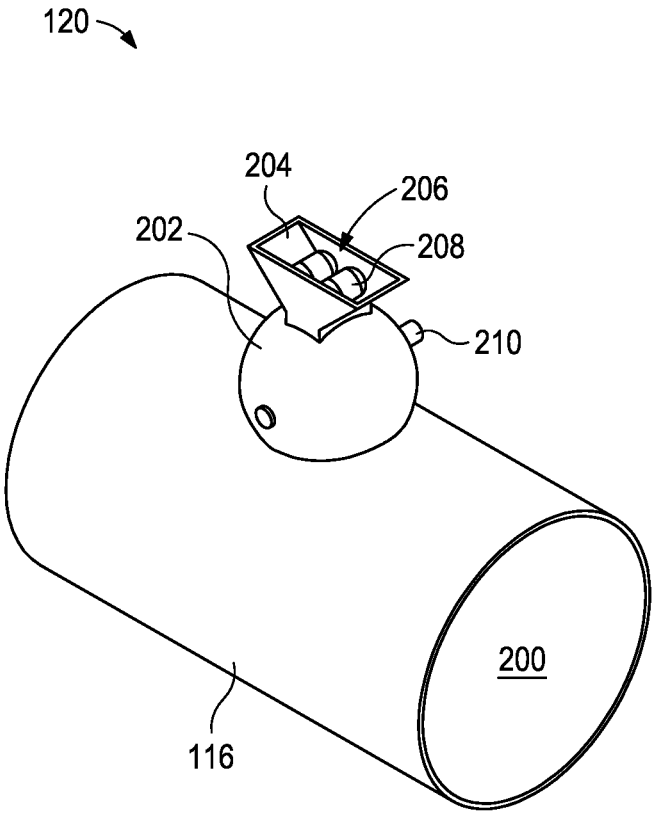
FIG. 2 is a perspective view of an example microchip deployment mechanism that may be used with the microchip deployment system of FIG. 1.

FIG. 2 depicts the mechanism 120 arranged on a section of the drilling fluid pipe 116, according to one or more embodiments. The mechanism 120 is arranged on the drilling fluid pipe 116 such that the mechanism 120 has access to a lumen 200 (or interior) of the drilling fluid pipe 116. For example, the mechanism 120 may be mounted to the outer circumference of the drilling fluid pipe 116 and at an opening or hole (obscured from view) defined in the drilling fluid pipe 116.

In the illustrated embodiment, the mechanism 120 includes a housing 202 and a hopper 204 coupled to the housing 202. The hopper 204 is a carrier structure that defines a storage space 206 within which a plurality of microchips 208 may be stored for deployment. The housing 202 defines an interior space within which various internal components of the mechanism 120 are arranged, and the storage space 206 of the hopper 204 is in communication with the interior space of the housing 202, such that the microchips 208 may enter the housing 202. As described below, the mechanism 120 is arranged as a spherical valve, and the housing 202 is spherical in shape and corresponding with the shape of the spherical valve housed therein. However, the housing 202 may have other geometries without departing from the present disclosure. The mechanism 120 includes a drive shaft 210 that is operable for actuating (opening, closing, etc.) the spherical valve. Here, the drive shaft 210 protrudes out of the housing 202 and may be operatively connected to the motor 122 (FIG. 1), for example, via the belt 130 or otherwise via one or more gears.

In embodiments, the microchips 208 are miniaturized sensing devices. In embodiments, the microchips 208 are self-powered and include a memory and/or a means for communicating with a surface based system, such as the controller 124 (and/or a user interface thereof). In embodiments, the microchips 208 may include one or more sensors in order to gather different types of data, including but not limited to temperature sensors, pressure sensors, magnetometers, acoustic sensors, vibration sensors, gyroscopic sensors, and/or accelerometers. In embodiments, the data is stored in the microchips 208 and such data may be retrieved when the microchips 208 are extracted from the system 100 at the surface 104; whereas, in other embodiments, the microchips 208 are in communication with the controller 124 and operable to (continuously or periodically) transmit the data to the controller 124. The microchips 208 may be appropriately sized such that they may be dispatched and pumped within the drilling fluid pipe 116 and down through the wellbore 106 without clogging.

Figure 3:
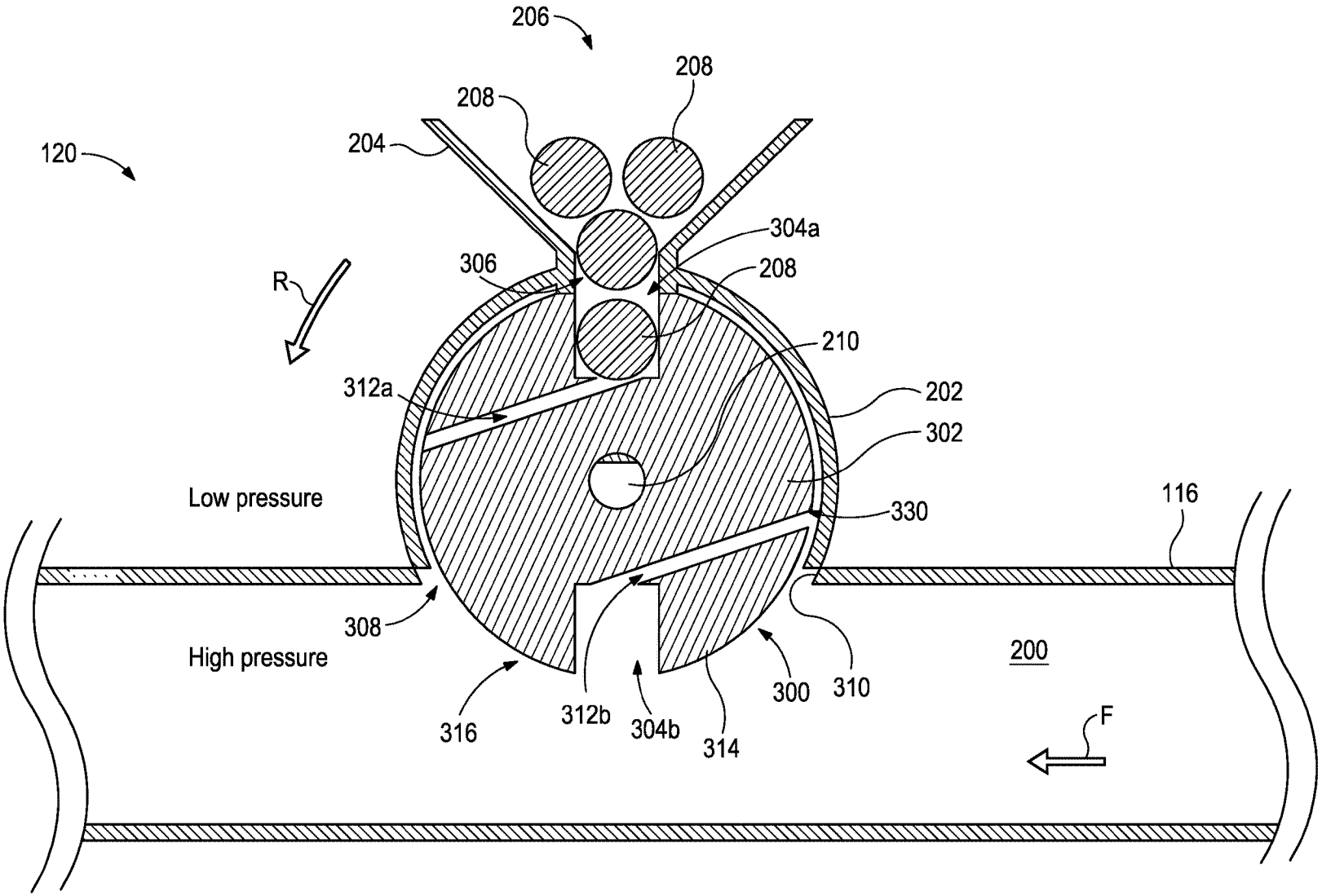
FIG. 3 is a cross-sectional side view of the microchip deployment mechanism of FIG. 2.

FIG. 3 depicts a cross-sectional end view of the mechanism 120, according to one or more embodiments. As shown, the mechanism 120 includes a spherical valve 300 rotatably arranged within the housing 202. The shaft 210 is attached to the spherical valve 300 such that rotation of the shaft 210 corresponding rotates the spherical valve 300. In the illustrated embodiment, the spherical valve 300 is configured to be rotated in a counter-clockwise direction R; however, the spherical valve 300 may instead be configured to be rotated in a clockwise direction, or the spherical valve 300 may instead be configured to be rotated in both the counter-clockwise direction R and clockwise direction.

The spherical valve 300 includes a valve body 302 that is sealingly provided within the housing 202 such that the spherical valve 300 is operable to isolate the high pressure drilling fluid flowing in the drilling fluid pipe 116 from the relatively lower pressure present in the ambient environment outside the drilling fluid pipe 116. The spherical valve 300, even when rotated as described herein, is operable to isolate the high pressure environment present within the lumen 200 of the drilling fluid pipe 116 and maintain it at such elevated pressure. Thus, the mechanism 120 may be operated continuously to deploy the microchips 208 into the drilling fluid pipe 116, without having to shut down other operations and/or depressurize the drilling fluid pipe 116.

The valve body 302 includes at least one microchip pocket for receiving the microchips 208. In the illustrated embodiment, the valve body 302 includes a pair of the microchip pockets, shown as first and second pockets 304*a* and 304*b*. In other embodiments, more or less than two pockets may be formed in the valve body 302. The microchip pockets 304*a*, 304*b* (collectively, the microchip pockets 304) are each shaped and sized to receive one of the microchips 208. In other embodiments, however, any one or more of the microchip pockets 304 may be shaped and sized to receive two or more microchips 208, without departing from the scope of the disclosure.

The housing 202 includes openings through which the microchips 208 may enter and exit the spherical valve 300. In the illustrated embodiment, the housing 202 includes an input opening 306 extending from or forming part of the hopper 204. The housing 202 may further include an output opening 308, and the housing 202 is arranged on the drilling fluid pipe 116 such that the output opening 308 is in communication with an aperture or opening 310 in the drilling fluid pipe 116. Also in the illustrated embodiment, the hopper 204 is provided over the input opening 306, such that microchips 208 stored in the storage space 206 of the hopper 204 may be automatically gravity-fed into the microchip pockets 304 of the spherical valve 300 through the input opening 306 in the housing 202. In the illustrated embodiment, the hopper 204 is a funnel shaped structure; however, the hopper 204 may have a different configuration suitable for feeding the microchips 208 into the spherical valve 300.

The valve body 302 may be rotated within the housing 202 such that one of the microchip pockets 304 aligns with or is proximate to the input opening 306. In FIG. 3, the valve body 302 has been rotated to position the spherical valve 300 in a receiving position, where the first microchip pocket 304*a* is aligned with the input opening 306 such that one of the microchips 208 may fall or otherwise be received within the first microchip pocket 304*a*.

In embodiments where the spherical valve 300 has more than one microchip pocket, the spherical valve 300 will have more than one receiving position, as such spherical valve 300 will be in a receiving position whenever one of its microchip pockets is aligned with the input opening 306. In the embodiment of FIG. 3, which includes two microchip pockets 304*a,b*, the spherical valve 300 has a first receiving position where the first microchip pocket 304*a* is aligned with the input opening 306 and a second receiving position where the second microchip pocket 304*b* is aligned with the input opening 306. In other embodiments where the spherical valve 300 has just one microchip pocket, such spherical valve has just one receiving position, and in embodiments where the spherical valve 300 has more than two microchip pockets, such spherical valve may have the same number of receiving positions as microchip pockets, with each of the receiving positions occurring when the microchip pocket is aligned with the input opening 306.

To discharge the microchip 208 into the interior of the drilling fluid pipe 116, the valve body 302 may be rotated within the housing 202 until one of the microchip pockets 304 aligns with or is proximate to the output opening 308. In FIG. 3, the valve body 302 has been sufficiently rotated to position the spherical valve 300 in a deploying position, where the second microchip pocket 304*b* is aligned with the output opening 308, such that the housing 202 does not block or cover the second microchip pocket 304*b*. When uncovered by the housing 202, the microchip 208 may drop/fall out of the microchip pocket 304*b* and enter the flow of drilling fluid F within the drilling fluid pipe 116. In embodiments where the spherical valve 300 has more than one microchip pocket, the spherical valve 300 will have more than one deploying position. Accordingly, the spherical valve 300 will be in a deploying position whenever one of its microchip pockets is aligned with the output opening 308. Thus, in the embodiment of FIG. 3, the spherical valve 300 has a first deploying position where the second microchip pocket 304*b* is aligned with and proximate to the output opening 308 and a second deploying position where the first microchip pocket 304*a* is aligned with and proximate to the output opening 308. However, in embodiments where the spherical valve 300 has just one microchip pocket, such spherical valve has just one deploying position, and in embodiments where the spherical valve 300 has more than two microchip pockets, such spherical valve may have the same number of deploying positions as microchip pockets, with each of the deploying positions occurring when the microchip pocket is aligned with the output opening 308.

Operation of the spherical valve 300 is configured to facilitate deployment of the microchips 208 from the microchip pockets 304. In the illustrated embodiment, a (first) push channel 312*a* is formed in the valve body 302 for assisting in deployment of the microchip 208 from the first microchip pocket 304*a* and a second push channel 312*b* is formed in the valve body 302 for assisting in deployment of the microchip 208 from the (second) microchip pocket 304*b*. As shown in the cross section of FIG. 3, the push channels 312*a*, 312*b* (collectively, the push channels 312) each extend through the valve body 302, from one of the microchip pockets 304, to an outer surface 314 of the valve body 302. Here, for example, the first push channel 312*a* extends from a base of the first microchip pocket 304*a* to a first location on the outer surface 314 of the valve body 302, and the second push channel 312*b* extends from a base of the second microchip pocket 304*b* to a second location on the outer surface 314 of the valve body 302. With this arrangement, when the spherical valve 300 is in the deploying position with the first microchip pocket 304*a* positioned proximate to the output opening 308, the first location on the outer surface 314 of the valve body 302 associated with the first push channel 312*a* will also be proximate to the output opening 308, and when the spherical valve 300 is in the deploying position with the second microchip pocket 304*b* positioned proximate to the output opening 308, the second location on the outer surface 314 of the valve body 302 associated with the second push channel 312*b* will also be proximate to the output opening 308.

When evaluated in cross-section, the push channels 312 each extend along a secant of the valve body 302. However, the push channels 312 may be differently oriented and/or may communicate with their associated microchip pocket 304 at a different portion (i.e., rather than the base) of their associated microchip pocket 304. In addition, when the mechanism 120 is assembled on the drilling fluid pipe 116 with the output opening 308 of the housing 202 sealed over and around the opening 310 in the drilling fluid pipe 116, at least a portion 316 of the spherical valve 300 extends into the lumen 200 of the drilling fluid pipe 116, as depicted in FIG. 3.

During use, when the spherical valve 300 is rotated into the deploying position, an opening 330 of one of the push channels 312 formed in the outer surface 314 will face a flow F of the drilling fluid, such that the flow F of drilling fluid will enter the particular push channel 312 via the opening 330, travel through the push channel 312 and then enter the microchip pocket 304, and then operate to push (or flush out) the microchip 208 from the microchip pocket 304 and into the flow F of drilling fluid.

As described below, the push channels 312 depicted in FIG. 3 are arranged to be utilized with the spherical valve 300 when rotated in the counter-clockwise direction R. However, in other embodiments, one or more of the flow channels 312 may be arranged to work when the spherical valve 300 is rotated in the clockwise direction, for example, by extending through the valve body 302 such that the opening 330 thereof is exposed to the flow F of drilling fluid before the microchip pocket 304 associated therewith. In embodiments, the push channel 312 associated with one of the microchip channels 304 is oriented to be used with rotation in the counter-clockwise direction R and the push channel 312 associated with another one of the microchip channels 304 is oriented to be used with rotation in the clockwise direction. Regardless, the push channels 312 are oriented to allow maintenance of high pressure within the drilling fluid pipe 116 and operable to allow constant rotation of the spherical valve 300 (albeit, at varying speed as described below) without causing de-pressurization of the drilling fluid pipe 116. Also, the orientation/angle at which the push channels 312 extend through the valve body 302 may be selected such that the push channels 312 are pressurized for releasing the microchips 208 when the microchip pockets 304 are at a certain rotational position within the high pressure environment of the lumen 200 of the drilling fluid pipe 116.

Figure 4:
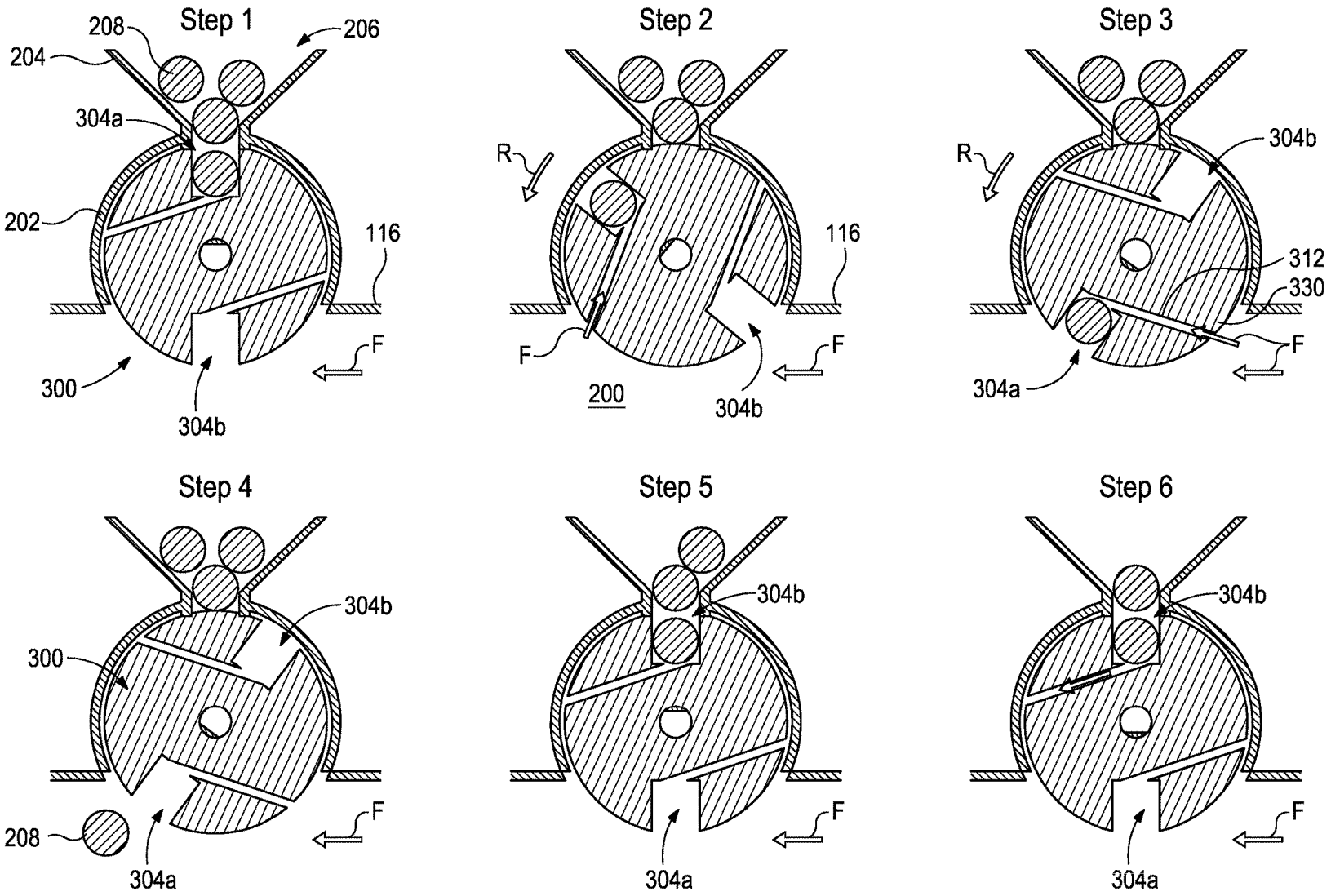
FIG. 4 depicts example progressive operation of the microchip deployment mechanism of FIGS. 2 and 3.

FIG. 4 depicts example progressive operation of the mechanism 120, according to one or more embodiments. As shown in Step 1, the method of operation includes loading the microchips 208 into the mechanism 120. In particular, loading the microchips 208 into the mechanism 120 may include loading the microchips 208 into the storage space 206 defined within the hopper 204. In addition, loading the microchips 208 into the mechanism 120 may include feeding the microchips 208 through the input opening 306 in the housing 202, one at a time, such that one of the microchips 208 is fed/loaded into one of the microchip pockets 304. In the depicted Step 1, the spherical valve 300 has been rotated into a receiving position where the first microchip pocket 304*a* is aligned with the input opening 306 in the housing 202 such that one of the microchips 208 has entered the first microchip pocket 304*a* with the aid of gravity (e.g., it falls in).

Referring now to Step 2 in FIG. 4, the operational method includes rotating the spherical valve 300, with one of the microchips 208 entered into the first microchip pocket 304*a*, towards the deploying position. In the illustrated embodiment, the spherical valve 300 is rotated in the counter-clockwise direction R; however, the spherical valve 300 may instead be rotated in a clockwise direction, or the spherical valve 300 may instead alternate between rotation in the counter-clockwise direction R and clockwise direction. As shown in Step 2, the first microchip pocket 304*a* has been rotated within the housing 202 to a position between the receiving position and the deploying position, such that the inner wall of the housing 202 is helping contain the microchip 208 within the first microchip pocket 304*a*. Also, when the first microchip pocket 304*a* is in this position between the receiving position and the deploying position (i.e., an "in-between" position), the opening 330 of the push channel 312 associated with the first microchip pocket 304*a* is exposed to the lumen 200 of the drilling fluid pipe 116, and it is possible that some flow f may enter the opening 330 and the push channel 312 thereof. However, discharging of the microchip 208 from the first microchip pocket 304*a* is inhibited due to the housing 202, which blocks and retains the microchip 208 within the microchip pocket 304*a*.

Further rotation of the spherical valve 300 will move or position the spherical valve 300 into the deploying position, as shown in Step 3 and Step 4 of FIG. 4. With regard to Step 3, when the spherical valve 300 is in the deploying position, the first microchip pocket 304*a* is unobstructed and uncovered by the housing 202, such that the microchip 208 within the first microchip pocket 304*a* is fully exposed to the flow F of drilling fluid, and the opening 330 of the push channel 312 will be facing the flow F of drilling fluid such that some flow f may enter the first microchip pocket 304*a* via the opening 330 and the push channel 312 associated therewith. As shown in Step 4, the flow f of drilling fluid entering the microchip pocket 304*a* pushes (ejects) the microchip 208 out of the first microchip pocket 304*a*. Accordingly, the method may include deploying the microchip 208 out of the first microchip pocket 304*a* when the spherical valve 300 is in the deploying position.

Further rotation of the spherical valve 300 in the counter-clockwise direction R will move the second microchip pocket 304*b* into the receiving position, wherein another one of the microchips 208 may be loaded into the second microchip pocket 304*b*, as shown in Step 5. Then, the operational method may include rotating the spherical valve 300 within the housing 202 towards the deploying position, and then deploying the microchip 208 from the second microchip pocket 304*b* into the drilling fluid pipe 116 when the spherical valve 300 is in the deploying position. Then, the spherical valve 300 may be further rotated in the counter-clockwise direction R until the spherical valve 300 is in the receiving position such that another one of the microchips 2108 may be loaded into the first microchip pocket 304*a*, as shown in Step 6. The operational method may continue in that sequence.

The operational method may also include removing the microchips 208 from the drilling fluid returns. The microchips 208 may be removed/retrieved at the surface 104, for example, the microchips 208 may be manually removed/retrieved or a retrieval mechanism may be utilized to remove the microchips 208 from the drilling fluid returns, such as from the drilling fluid pipe 116. The retrieval mechanism may comprise different types of mechanisms, such as automated detection and retrieval systems, mechanical catching systems, magnetized systems, etc. In other embodiments, the microchips 208 are sacrificial and need not be removed.

The operational method may further include reading the microchips 208 and/or retrieving the data from the microchips 208. The step of reading the microchips 208 may occur before or after the microchips 208 are retrieved/removed. For example, in embodiments where the microchips 208 are operable to transmit data to the controller 124 when located down hole, the step of reading the microchips 208 may occur before they are retrieved/removed. However, in embodiments where the microchips 208 are configured to be read at the surface via a reading device, the step of reading the microchips 208 may occur after the microchips 208 are retrieved/removed. Different types of devices and systems (wired or wireless) may be utilized to read the data from the microchips 208.

Figure 5:
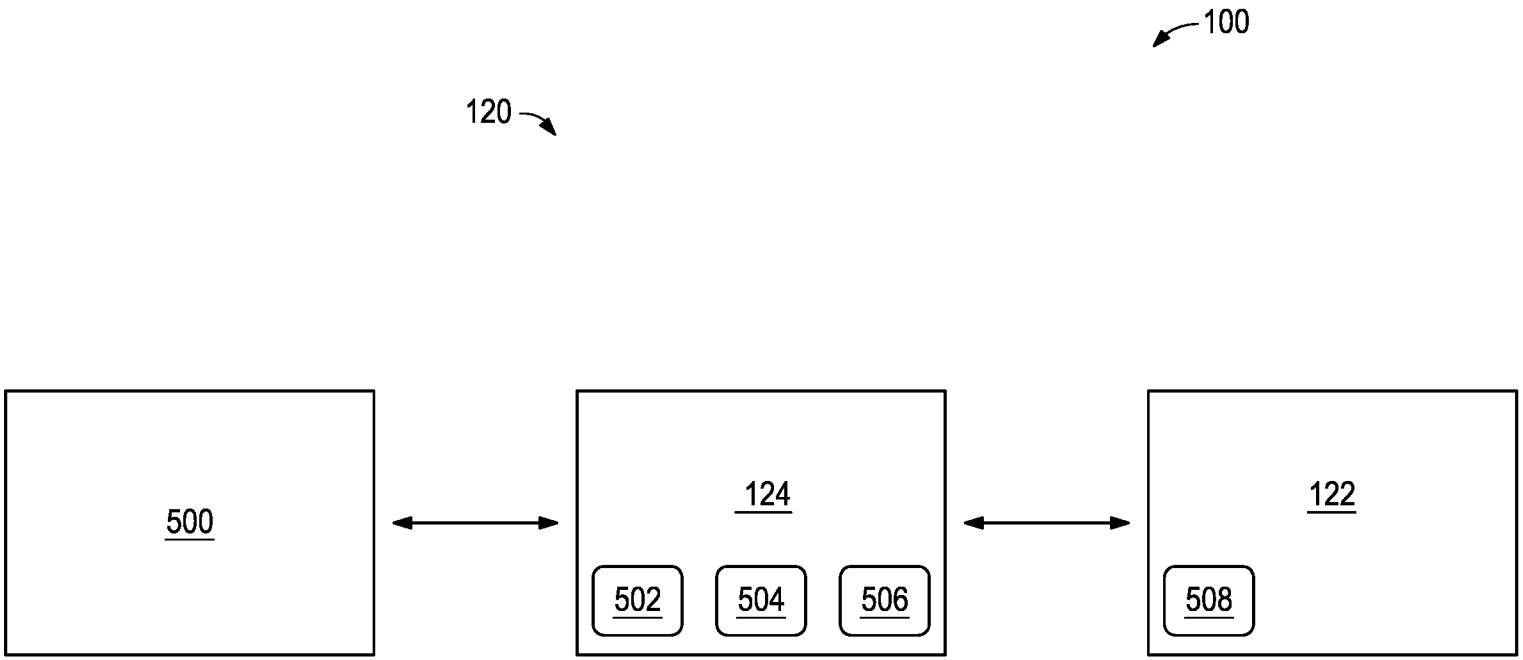
FIG. 5 is a block diagram of the microchip deployment mechanism of the microchip deployment system of FIG. 1.

FIG. 5 is an example block diagram of the system 100 and the mechanism 120, according to one or more embodiments. As shown, the system 100 includes a user interface 500 that is operable for controlling and programming control of the mechanism 120. The controller 124 may include a memory 502, a real time clock 504, and a processor 506. The user interface 500 allows a user to program deployment schedules for deploying the microchips 208 and to program the rate at which the microchips 208 are deployed. Such programmed schedules and rates may be stored in the memory 502. The processor 506 may then control operation of the motor 122 based on the instructions stored the memory, wherein such instructions may include the programmed schedules and rates. Thus, the mechanism 120 is operable to automatically deploy the microchips 208 according to the user programmed deployment schedule.

The controller 124 may also monitor operation of the motor 122. For example, the controller 124 may monitor the speed at which the motor 122 is operating, such that the processor 506 may fine tune operation of the motor 122 to conform to the pre-programmed deployment schedule and/or rate of deployment. In embodiments, the motor 122 includes a motion sensor 508 that is in communication with the controller 124, such that the controller is operable to sense the speed at which the motor 122 is operating. Thus, the controller 124 is operable to manage driving the motor 122 and to send the rotation command to the motor 122 as per the user requirements input on the user interface after sensing the motion of the motor 122 via the motion sensor 508. The user interface 500 may also include a screen or graphical display (GUI) for the user to monitor and/or control operation of the mechanism 120.

Figure 6:
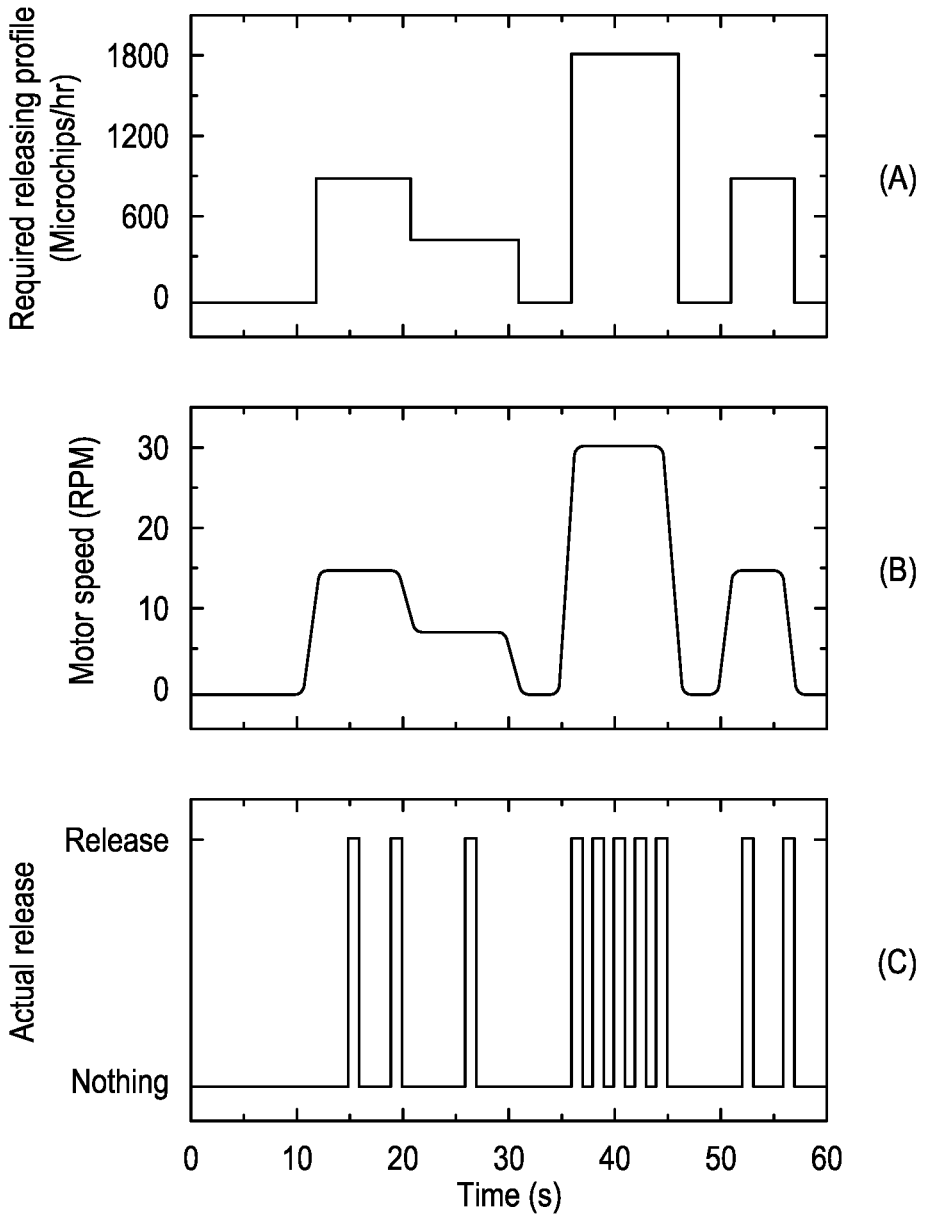
FIG. 6 is an example user programmed profile for deploying microchips.

FIG. 6 depicts plots corresponding with an example deployment schedule, according to one or more embodiments. As mentioned above, a user may input/program into the controller 124 a deployment schedule at which the mechanism 120 automatically releases the microchips 208, and such deployment schedule may be stored in the memory 502 of the controller 124. The first plot (A) of FIG. 6 depicts a profile of an example deployment schedule over one hour. The processor 506 is operable to calculate a speed that the motor 122 may be driven to achieve the deployment schedule profiled in the first plot (A). The second plot (B) of FIG. 6 depicts a profile of the motor speed calculated by the processor 506 to achieve the user programmed deployment schedule profiled in the first plot (A). The third plot (C) depicts a profile of the actual rate of deployment of the microchips 208, which thereby demonstrate that the mechanism 120 is deploying the microchips 208 in conformance with the deployment schedule programmed by the user.

Accordingly, a user may input into the controller 124 a deployment schedule for the mechanism 120 to release the microchips 208 (see first plot (A)), which may be translated into a motor speed profile (see second plot (B)), and thereby deploy automatically the microchips 208 one at a time (one by one) and with a desired frequency, as shown in the third plot (C). The plots of FIG. 6 may be depicted on the display of the user interface 500. Thus, the mechanism 120 may be operated autonomously after the user has programmed/set the deployment schedule in the controller 124 and filled the hopper 204 with the microchips 208. In addition, the mechanism 120 is able to operate without stopping the operation or depressurize the drilling fluid pipe 116 to deploy the microchips 208.

Embodiments disclosed herein include:

A. A microchip deployment mechanism, comprising: a housing defining an input opening and an output opening; and a spherical valve rotatably arranged within the housing, the spherical valve including a valve body that defines a microchip pocket sized to receive a microchip, wherein the valve body is rotatable within the housing between a receiving position, where the microchip pocket is proximate to the input opening to receive the microchip, and a deploying position, where the microchip pocket is proximate to the output opening to discharge the microchip from the microchip pocket.

B. A microchip deployment system for a well, comprising: a drilling fluid pump; a drilling fluid pipe extending from the drilling fluid pump and in fluid communication with a wellbore; a microchip deployment mechanism provided on the drilling fluid pipe and including: a housing having an input opening and an output opening; and a spherical valve rotatably arranged within the housing, the spherical valve including a valve body that defines a microchip pocket sized to receive a microchip, wherein the valve body is rotatable within the housing between a receiving position, where the microchip pocket is proximate to the input opening to receive the microchip, and a deploying position, where the microchip pocket is proximate to the output opening to discharge the microchip from the microchip pocket.

C. A method comprising: loading a plurality of microchips into a hopper of microchip deployment mechanism, the microchip deployment mechanism being provided on a drilling fluid pipe and including: a housing having an input opening and an output opening; and a spherical valve rotatably arranged within the housing and including a valve body that defines a microchip pocket sized to receive a microchip of the plurality of microchips; rotating the valve body within the housing to a receiving position, where the microchip pocket is proximate to the input opening; receiving a first microchip of the plurality of microchips in the microchip pocket; rotating the valve body within the housing to a deploying position, where the microchip pocket is proximate to the output opening; and deploying the first microchip into the interior of the drilling fluid pipe when the valve body is in the deploying position.

Each of embodiments A, B, and C may have one or more of the following elements in any combination: Element 1: further comprising a hopper provided at the input opening of the housing and sized to receive a plurality of microchips. Element 2: wherein the spherical valve further includes a push channel defined in the valve body and extending from the microchip pocket to a location on an outer surface of the valve body. Element 3: wherein, when the valve body is in the deploying position, the location on the outer surface of the spherical valve is also proximate to the output opening.

Element 4: further comprising: a motor operatively coupled to the valve body such that operation of the motor causes the valve body to rotate; and a controller in communication with the motor to control operation of the motor. Element 5: further comprising a user interface in communication with the controller and providing an interface where a user is able to program the controller. Element 6: wherein the controller includes a memory, a real time clock, and a processor, and wherein the user interface is operable to input instructions to be stored on the memory, the instructions comprising at least one of a microchip deployment schedule and a microchip deployment rate. Element 7: wherein the controller is operable to sense a speed of the motor. Element 8: further comprising a derrick arranged at a well surface adjacent the drilling fluid pump, wherein the microchip deployment mechanism interposes the derrick and the drilling fluid pump. Element 9: wherein a portion of the valve body extends into the drilling fluid pipe. Element 10: wherein the microchip deployment mechanism further includes a push channel defined in the valve body and extending from the microchip pocket to a location on an outer surface of the valve body, the method further comprising exposing the location of the push channel to the interior of the drilling fluid pipe and thereby allowing a portion of drilling fluid circulating within the drilling fluid pipe to flush the first microchip out of the microchip pocket.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A microchip deployment mechanism, comprising:

a housing defining an input opening and an output opening; and a spherical valve rotatably arranged within the housing, the spherical valve including a valve body that defines a microchip pocket sized to receive a microchip, wherein the valve body is rotatable within the housing between a receiving position, where the microchip pocket is proximate to the input opening to receive the microchip, and a deploying position, where the microchip pocket is proximate to the output opening to discharge the microchip from the microchip pocket, wherein the valve body has an outer surface and the microchip pocket extends into the outer surface of the valve body at a first location on the outer surface, and wherein the spherical valve further includes a push channel defined in the valve body and extending between the microchip pocket and an opening formed in the outer surface of the valve body at a second location on the outer surface.

2. The microchip deployment mechanism of claim 1, further comprising a hopper provided at the input opening of the housing and sized to receive a plurality of microchips.

3. The microchip deployment mechanism of claim 1, wherein, when the valve body is in the deploying position, the location on the outer surface of the spherical valve is also proximate to the output opening.

4. The microchip deployment mechanism of claim 1, further comprising:

a motor operatively coupled to the valve body such that operation of the motor causes the valve body to rotate; and a controller in communication with the motor to control operation of the motor.

5. The microchip deployment mechanism of claim 4, further comprising a user interface in communication with the controller and providing an interface where a user is able to program the controller.

6. The microchip deployment mechanism of claim 5, wherein the controller includes a memory, a real time clock, and a processor, and wherein the user interface is operable to input instructions to be stored on the memory, the instructions comprising at least one of a microchip deployment schedule and a microchip deployment rate.

7. The microchip deployment mechanism of claim 4, wherein the controller is operable to sense a speed of the motor.

8. A microchip deployment system for a well, comprising:

a drilling fluid pump;

a drilling fluid pipe extending from the drilling fluid pump and in fluid communication with a wellbore;

a microchip deployment mechanism provided on the drilling fluid pipe and including:

a housing having an input opening and an output opening; and a spherical valve rotatably arranged within the housing, the spherical valve including a valve body that defines a microchip pocket sized to receive a microchip, wherein a portion of the valve body extends into the drilling fluid pipe, wherein the valve body is rotatable within the housing between a receiving position, where the microchip pocket is proximate to the input opening to receive the microchip, and a deploying position, where the microchip pocket is proximate to the output opening to discharge the microchip from the microchip pocket.

9. The microchip deployment system of claim 8, further comprising a derrick arranged at a well surface adjacent the drilling fluid pump, wherein the microchip deployment mechanism interposes the derrick and the drilling fluid pump.

10. The microchip deployment system of claim 8, further comprising a hopper provided at the input opening of the housing and sized to receive a plurality of microchips.

11. The microchip deployment system of claim 8, wherein the spherical valve further includes a push channel defined in the valve body and extending from the microchip pocket to a location on an outer surface of the valve body.

12. The microchip deployment system of claim 11, wherein, when the valve body is in the deploying position, the location on the outer surface of the spherical valve is also proximate to the output opening.

13. The microchip deployment system of claim 8, wherein the microchip deployment mechanism further includes:

a motor operatively coupled to the valve body such that operation of the motor causes the valve body to rotate; and a controller in communication with the motor to control operation of the motor.

14. The microchip deployment system of claim 13, further comprising a user interface in communication with the controller and providing an interface where a user is able to program the controller.

15. The microchip deployment system of claim 14, wherein the controller includes a memory, a real time clock, and a processor, and wherein the user interface is operable to input instructions to be stored on the memory, the instructions comprising at least one of a microchip deployment schedule and a microchip deployment rate.

16. The microchip deployment system of claim 13, wherein the controller is operable to sense speed of the motor.

17. A method, comprising:

loading a plurality of microchips into a hopper of microchip deployment mechanism, the microchip deployment mechanism being provided on a drilling fluid pipe and including:

a housing having an input opening and an output opening;

a spherical valve rotatably arranged within the housing and including a valve body that defines a microchip pocket sized to receive a microchip of the plurality of microchips; and a push channel defined in the valve body and extending from the microchip pocket to a location on an outer surface of the valve body;

rotating the valve body within the housing to a receiving position, where the microchip pocket is proximate to the input opening;

receiving a first microchip of the plurality of microchips in the microchip pocket;

rotating the valve body within the housing to a deploying position, where the microchip pocket is proximate to the output opening;

deploying the first microchip into the interior of the drilling fluid pipe when the valve body is in the deploying position; and exposing the location of the push channel to the interior of the drilling fluid pipe and thereby allowing a portion of drilling fluid circulating within the drilling fluid pipe to flush the first microchip out of the microchip pocket.

* * * * *